United States Patent [19]

Shircliffe

[11] 4,241,901

[45] Dec. 30, 1980

[54] VEHICLE LIFT ASSEMBLY AND CONTROL SYSTEM THEREFOR

[75] Inventor: Donald F. Shircliffe, Louisville, Ky.

[73] Assignee: VBM Corporation, Louisville, Ky.

[21] Appl. No.: 848,895

[22] Filed: Nov. 7, 1977

[51] Int. Cl.[2] ..... B66F 7/12

[52] U.S. Cl. ..... 254/89 H

[58] Field of Search ..... 254/89 R, 89 H, 93 R, 254/45

[56] References Cited

U.S. PATENT DOCUMENTS

| | | | |
|---|---|---|---|
| 3,327,997 | 6/1967 | Zenke | 254/89 R |
| 3,507,476 | 4/1970 | Bennett | 254/45 |
| 4,050,673 | 9/1977 | Nishimura | 254/89 H |

*Primary Examiner*—Robert C. Watson

*Attorney, Agent, or Firm*—Maurice L. Miller, Jr.

[57] ABSTRACT

A vehicle lift having two hydraulically operated lifting cylinders for adjusting the height of a pair of weight supporting carriages, and having a control system featuring a cable strung between the carriages for responding, through changes in tension, to a change in relative vertical displacement between the carriages to actuate a levered valve assembly for controlling the rate of fluid being supplied to or from each lifting cylinder to eliminate the change and restore the preferred relative displacement between the carriages. The control system deactivates the lifts and effects engagement of safety latches to lock the carriages in place in their respective frames to limit misalignment thereof in the event of a control system malfunction. A fluid shuttle valve having a perforated cylinder which is both rotatable and translatable within the valve body to control fluid flow to and from each lifting cylinder is also featured.

18 Claims, 12 Drawing Figures

VEHICLE LIFT ASSEMBLY AND CONTROL SYSTEM THEREFOR

BACKGROUND OF THE INVENTION

This invention relates generally to lifting assemblies and more specifically to those which are not mechanically joined so as to be independently movable and non-synchronous relative to one another.

One difficulty which has been encountered using such prior art assemblies has been that of maintaining a preferred relative vertical displacement between the article supporting arms thereof as the arms translate along their frames. This problem can occur because of the difficulty in supplying the precisely proper rate of hydraulic fluid flow to each of the lifting cylinders in the assemblies, especially where the loading on each may differ widely either because the load they are lifting is off-center or because the weight of the article being lifted is not uniformly disbursed along the horizontal plane. Whatever the reason for the difficulty, it has often been found necessary in the past to physically and mechanically tie the lifting cylinders together to insure their synchorous movement. The subject invention overcomes this and other difficulties encountered in the prior art.

SUMMARY OF THE INVENTION

Briefly, in accordance with one object of the subject invention there is provided a control system for a pair of independently movable translating means. Means is employed for sensing a change in the relative displacement of such pair away from a preferred relative displacement of the pair. Also, means is provided which is operatively connected to such pair and responsive to such change, for restoring such pair to such preferred relative displacement.

This and other objects of the subject invention will become apparent to those skilled in the art from the following detailed description and attached drawings upon which, by way of example, only the preferred embodiments of the subject invention are illustrated.

DESCRIPTION OF THE PREFERRED EMBODIMENT

Figure 1:
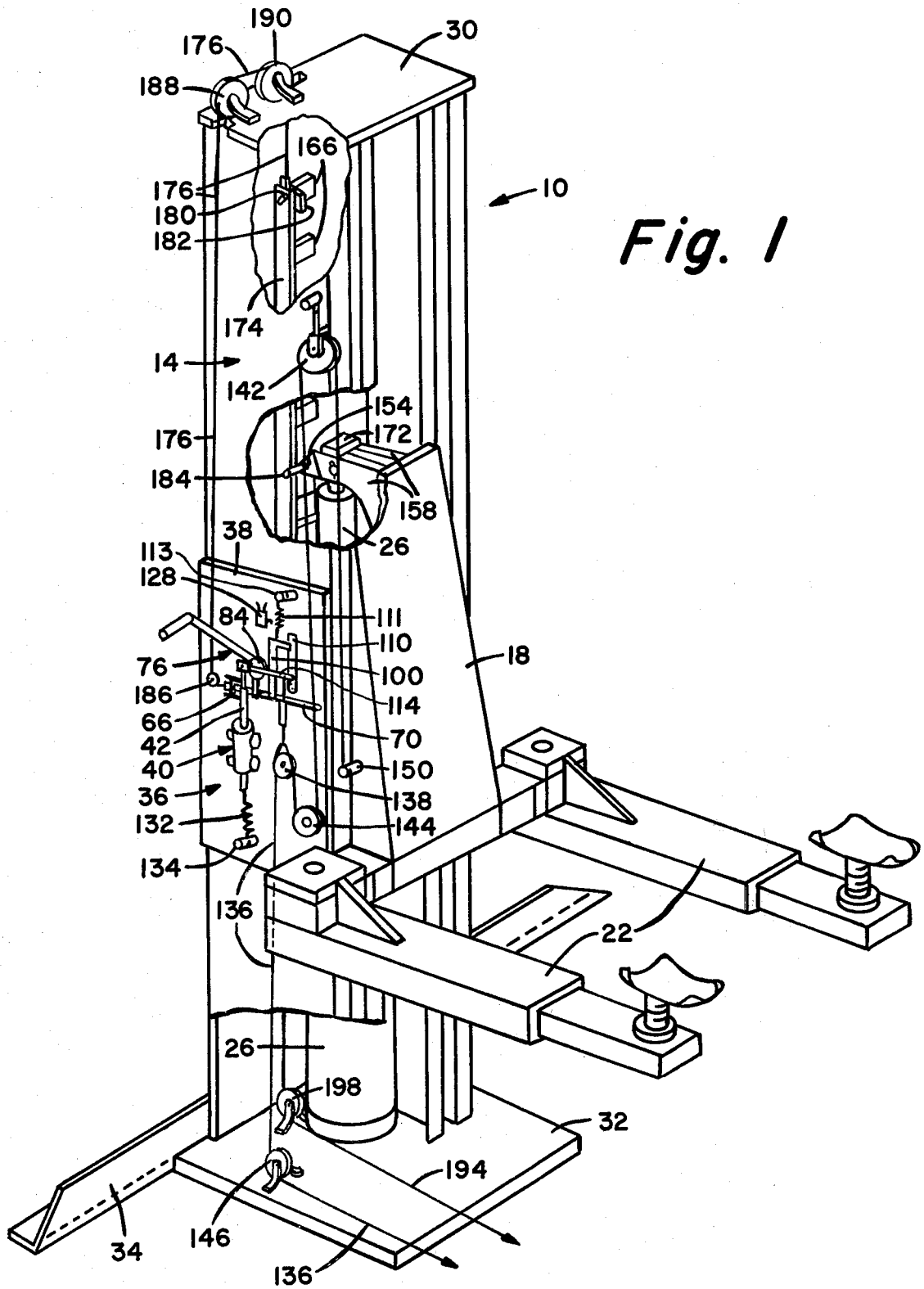
FIGS. 1–3 show, respectively, an oblique projection, a front elevation view and a side elevation view of one of a pair of vehicle lift assemblies with a control panel included thereon, illustrating one preferred embodiment of the subject invention.

Referring now to the figures, there is shown, in one preferred embodiment of the invention, a pair of surface mounted vehicle lift assemblies 10 and 12 having as generally conventionally components, a pair of metal frames 14 and 16, a pair of vertically movable carriages 18 and 20 with adjustable support arms 22 and 24 attached, and a pair of hydraulic lifting cylinders 26 and 28. Such components may be found on the automotive lifts currently being manufactured and sold by VBM Corporation, 1402 West Main Street, Louisville, Kentucky 40201 under the trademark "Vogt". Since the supporting structure of both of the assemblies 10 and 12 is basicaly indentical, only that of the assembly 10 is shown in detail including a top plate 30, a bottom plate 32 and a support brace 34. The assemblies 10 and 12 form independently movable translating means since the carriages 18 and 20 are not mechanically joined together so as to move in unison. It is thus possible for the prior art mechanisms of this type to move non-synchronously with respect to one aother such that the relative vertical displacement of the arms 22 and 24 may change with respect to their preferred relative vertical alignment.

Now, in accordance with the principles of the invention, there is shown a control panel 36 mounted on a side of the frame 14 adjacent the carriabe 18 at a conveniently accessible height above the base 32. The panel 36 includes a mounting plate 38 upon which is secured a novel hydraulic shuttle valve 40 having an elongated hollow cylinder 42 having closed ends and being slidably disposed both rotationally and translationally within a shaft define by a valve body 44. The cylinder 42 defines a series of six strategically placed holes 46, 48, 50, 52, 54 and 56 through its wall which, depending upon the rotational displacement of the cylinder 42 relative to the valve body 44, permits hydraulic fluid to flow through the latter to lengthen or shorten the cylinders 26 and 28 to raise or lower the carriages 18 and 20.

Figure 4:
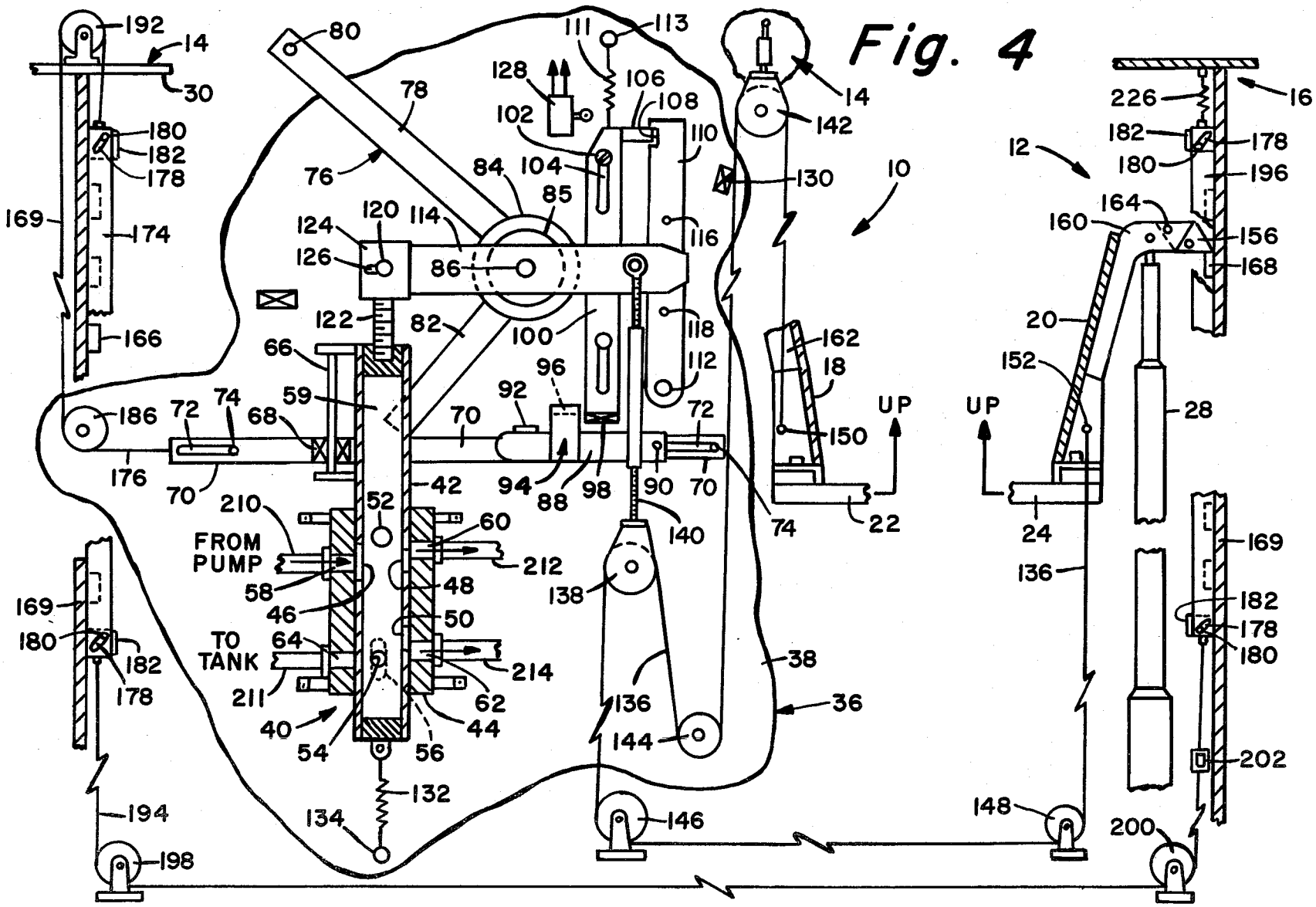
FIG. 4 shows a detailed view of the control panel of FIGS. 1–3 and its operating relationship to a pair of vehicle lift assemblies illustrating the up condition thereof.
Figure 5:
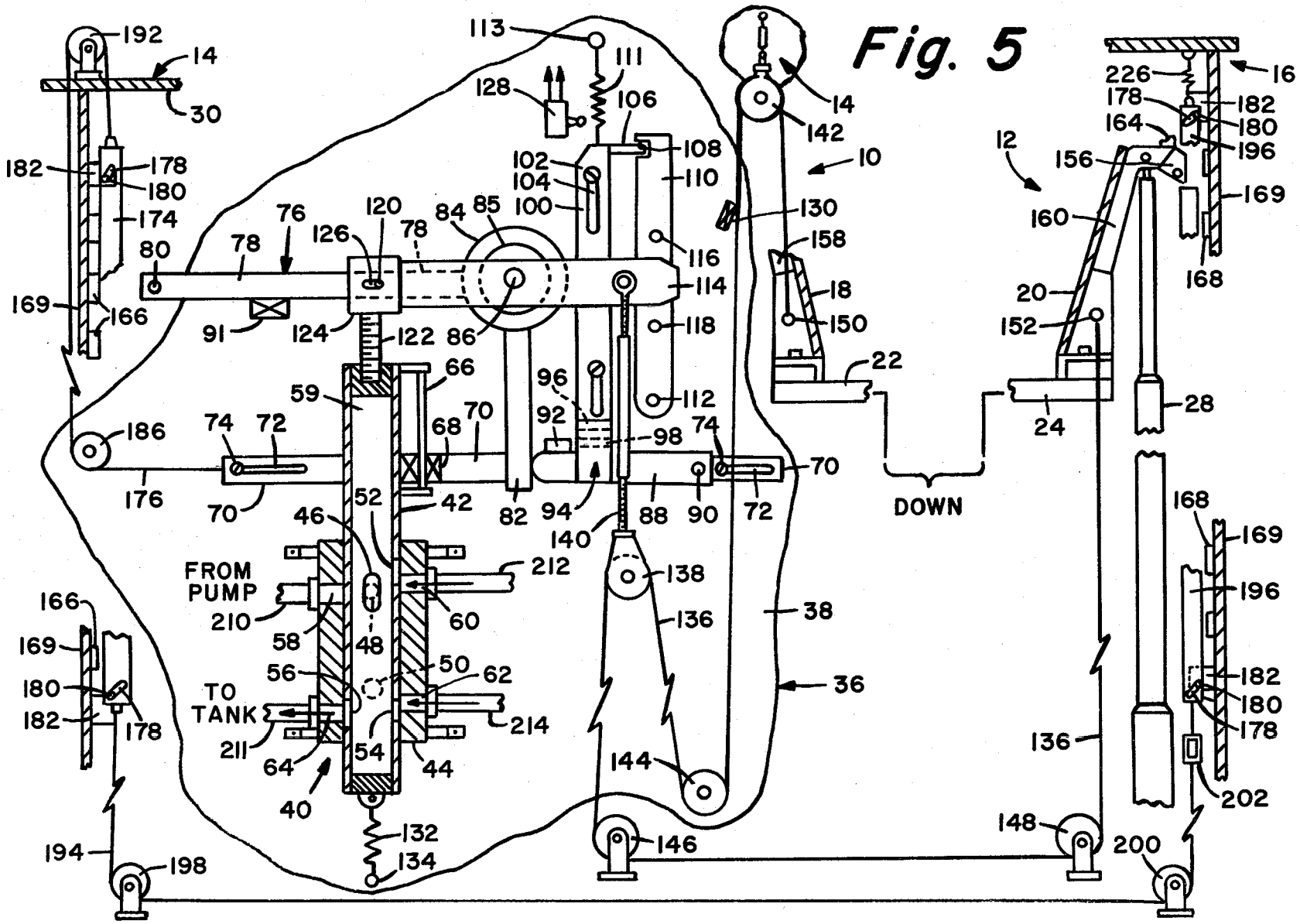
FIG. 5 shows a detailed view of the control panel of FIGS. 1–3 and its operating relationship to a pair of vehicle lift assemblies illustrating the down condition of operation thereof.
Figure 6:
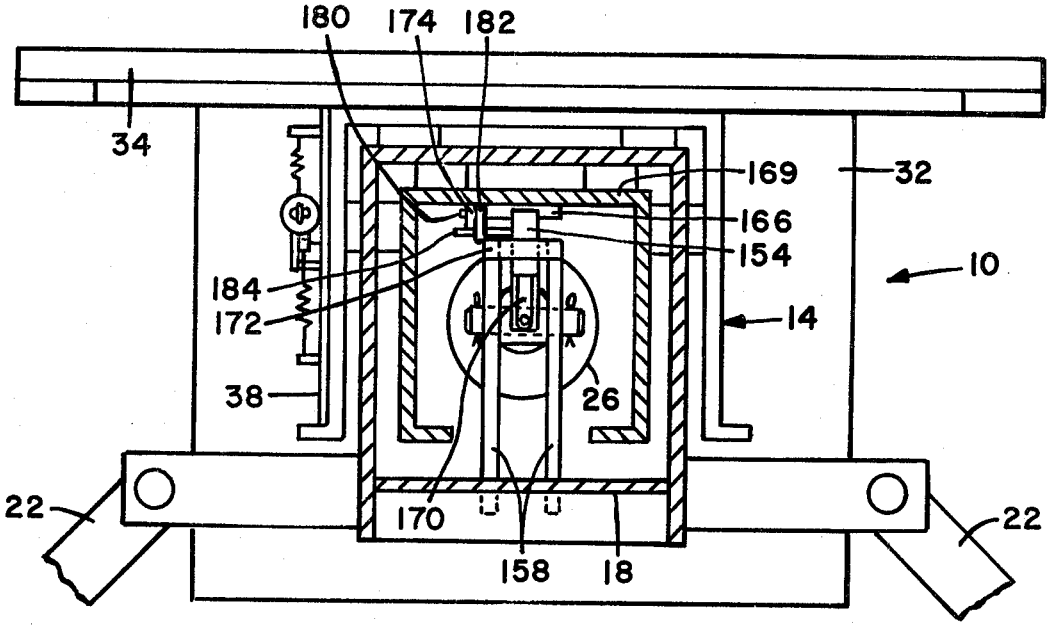
FIGS. 6–7 show, respectively, plan and side elevation views of a safety latch system employed in the assembly of FIGS. 1–3.
Figure 7:
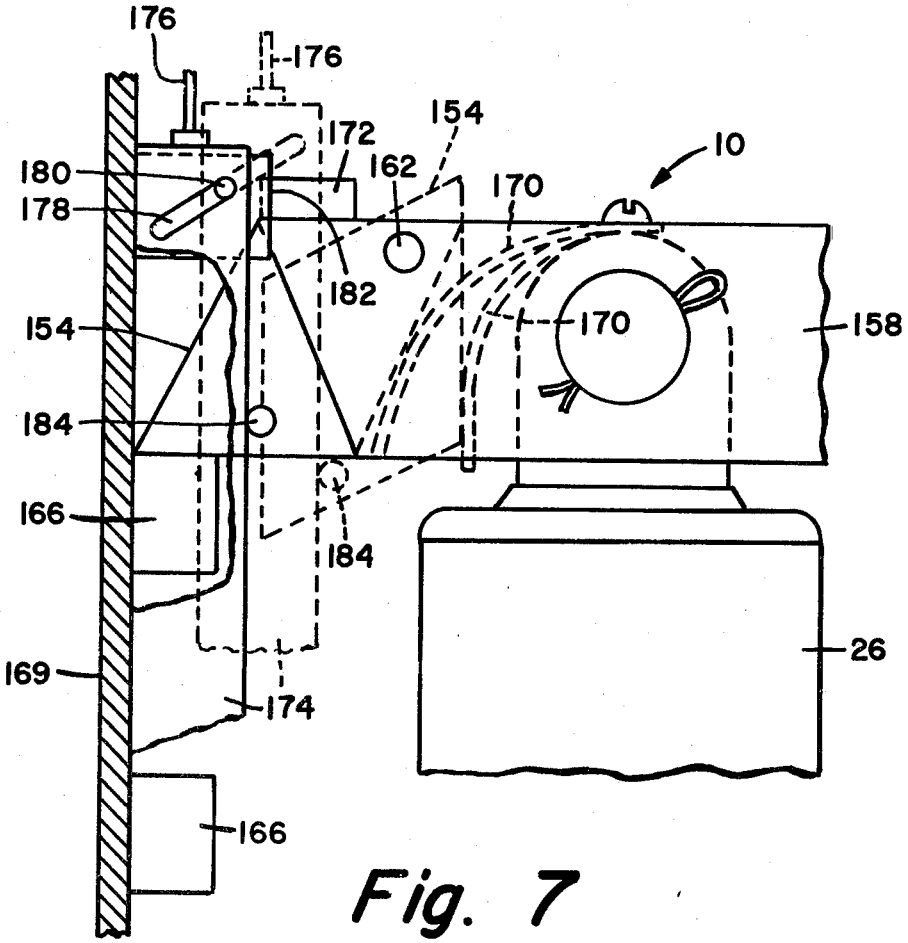

FIG. 4 illustrates the "up" condition of the valve 40 wherein the hole 46 registers with a pump inlet port 58 to allow hydraulic fluid, under pressure, to flow into a cavity 59 defined by the cylinder 42 and, thereafter, pass through the holes 48 and 50 to a pair of lifting cylinder access ports 60 and 62. FIG. 5 illustrates the "down" condition of the valve 40 wherein the cylinder 42 is rotationally displaced 90 degrees from its positio as shown in FIG. 4 to permit hydraulic fluid to flow from the lifting cylinders 26 and 28 through the access ports 60 and 62 and the holes 52 and 54 across the cavity 59 and into a hydraulic fluid holding tank drain port 64. It should be noted that the hole 56 as viewed in FIG. 4 and the holes 48 and 50 as viewed in FIG. 5 are shown in phantom as indicated by dashed lines since they are located on that portion of the wall of the cylinder 42 nearest the viewer which has been removed by cross-sectioning. In FIG. 4, the hole 56 nearest the viewer registers with the hole 54 directly across the cavity 59 while in FIG. 5, the hole 48 nearest the viewer registers with the hole 46 directly across the cavity 59.

The valve 40 is operated rotationally to shift between the up and down conditions of the assemblies 10 and 12 by means of a handle 66 attached to an upper end portion of the cylinder 42. The handle 66 is, in turn, trapped between a pair of blocks 68 projecting from an elongated horizontal slide bar 70. The bar 70 is provided with elongated slots 72 through which suitable fasteners 74 project to slidably secure it to the plate 38. Accordingly, horizontal sliding movement of the bar 70 along the fasteners 74 between the ends of the slots 72 produces a right angular rotational displacement of the valve cylinder 42 about its longitudinal axis to effect a shift in the mode or condition of operation of the assemblies 10 and 12 from upward movement as shown in FIG. 4 to downward movement as shown in FIG. 5 and vice versa.

As mentioned previously, the valve cylinder 42 is also translationally slidable through the valve body 44 along its longitudinal axis. Such movement affects the comparative rate of flow of the hydraulic fluid through the valve 40 to and from the access ports 60 and 62. Referring particularly to FIG. 4, it will be seen that a downward movement of the cylinder 42 past a preselected centered position in the valve body 44 moves the hole 48 downwardly away from registry with the port 60 to reduce the flow of hydraulic fluid from the inlet port 58 through the cavity 59, to the access port 60. Simultaneously, the same movement slides the hole 50 from partial toward complete registration with the access port 62 to increase the flow of hydraulic fluid from the inlet port 58, through the cavity 59, to the access port 62. The result of such downward movement of the cylinder 42 is to decrease the flow of hydraulic fluid to the cylinder 26 to slow the rate of upward lengthening thereof while simultaneously increasing the flow to the cylinder 28 to increase the rate of upward lengthening thereof. Conversely, should the cylinder 42 be translated in the upward direction through the valve body 44 past its preselected centered position while the assemblies 10 and 12 are operating in the up condition as shown in FIG. 4, the fluid flow rate to the access port 60 will increase while the flow rate to the access port 62 will decrease. The result of this latter movement of the cylinder 42 is to increase the rate of lengthening of the cylinder 26 while simultaneously reducing the rate of lengthening of the cylinder 28.

Referring now particularly to FIG. 5, a downward movement of the cylinder 42 past its preselected centered position increases the amount of registration between the hole 52 and the access port 60 to increase the rate of shortening of the lifting cylinder 26, while simultaneously decreasing the amount of registration between the hole 54 and the port 62 to decrease the downward rate of shortening of the cylinder 28. Lifting of the cylinder 42 past its preselected centered position in the valve body 44 produces the opposite effect upon the rate of shortening of the lifting cylinders 26 and 28.

Accordingly, vertical movement of the cylinder 42 through the valve body 44 can be employed to alter the relative speeds of the lifting cylinders 26 and 28 to correct an error in horizontal misalignment between the support arms 22 and 24 during both upward and downward movement thereof. Preferably, the holes 46 and 56 should be elongated in the vertical direction to form slots which maintain substantially maximum communication between the ports 58 and 64, respectively, and the cavity 59 as the cylinder 42 is vertically adjusted to alter the comparative fluid flow rate from and to the lifting cylinders 26 and 28.

Upward and downward movement of the assemblies 10 and 12 is selected by means of a right angular lever 76 which includes a first leg 78 containing a suitable handle 80 on the free end thereof and a second leg 82. The legs 78 and 82 are welded or otherwise fixedly attached to a circular disc 84 which is pivotally connected to a disc 85, the latter disc being, in turn, welded or otherwise affixed to the plate 38. The legs 78 and 82 and the disc 84, therefore, rotate in unison about the disc 85 as the lever 76 is operated. With the lever 76 in the down position of operation as shown in FIG. 5, the leg 82 extends vertically downward from the disc 84 to a position of interference with the blunted free end of a bar 88 which is pivotally attached on its other end to the slide bar 70 by means of a pivot pin 90. The force of the leg 82 bearing against the bar 88 forces the slide bar 70 to maintain a retracted position fully to the right as viewed in FIG. 5. A block 91 is attached to the plate 38 and projects outward therefrom to form a stop against which the leg 78 may rest when in the horizontal position shown in FIG. 5.

A stop 92 consisting of a thin rectangular element is welded or otherwise affixed to the upper edge of the bar 88 near its blunted free end so as to extend across the upper edge of the slide bar 70 (into the paper as viewed in FIGS. 4 and 5) to restrain the blunted free end of the bar 88 from pivoting counterclockwise about the pin 90 to a position below the level of the slide bar 70. Also attached to the bar 88 is a right angular element 94 having a horizontal leg 96 spaced above the upper edge of the bar 88 and extending into the paper as viewed in FIGS. 4 and 5 so as to overlie a block 98 extending outward toward the viewer from a bottom end portion of a vertical slide bar 100 when the horizontal slide bar 70 and latch 88 are in the retracted positions as shown in FIG. 5. The element 94 is adjacent and to the left of the bar 100 when the assemblies 10 and 12 are operated in an up condition as shown in FIG. 4. The bar 100 is slidably attached to the plate 38 by means of fasteners 102 extending through elongated vertical slots 104.

A latch key 106, which may be in the form of a flat rectangular lip, projects horizontally outward from an upper end portion of the bar 100 and extends under normal operating conditions into a slot 108 formed in an upper end portion of a latch 110. The latch 110 is pivotally attached on its lower end portion to the plate 38 by means of a pivot pin 112. The bar 100 is biased toward an upwardly extended position by means of a spring 111 held in a suitable degree of tension for raising the bar 100 and connected between an upper end thereof and a peg 113 affixed to the plate 38.

Figure 8:
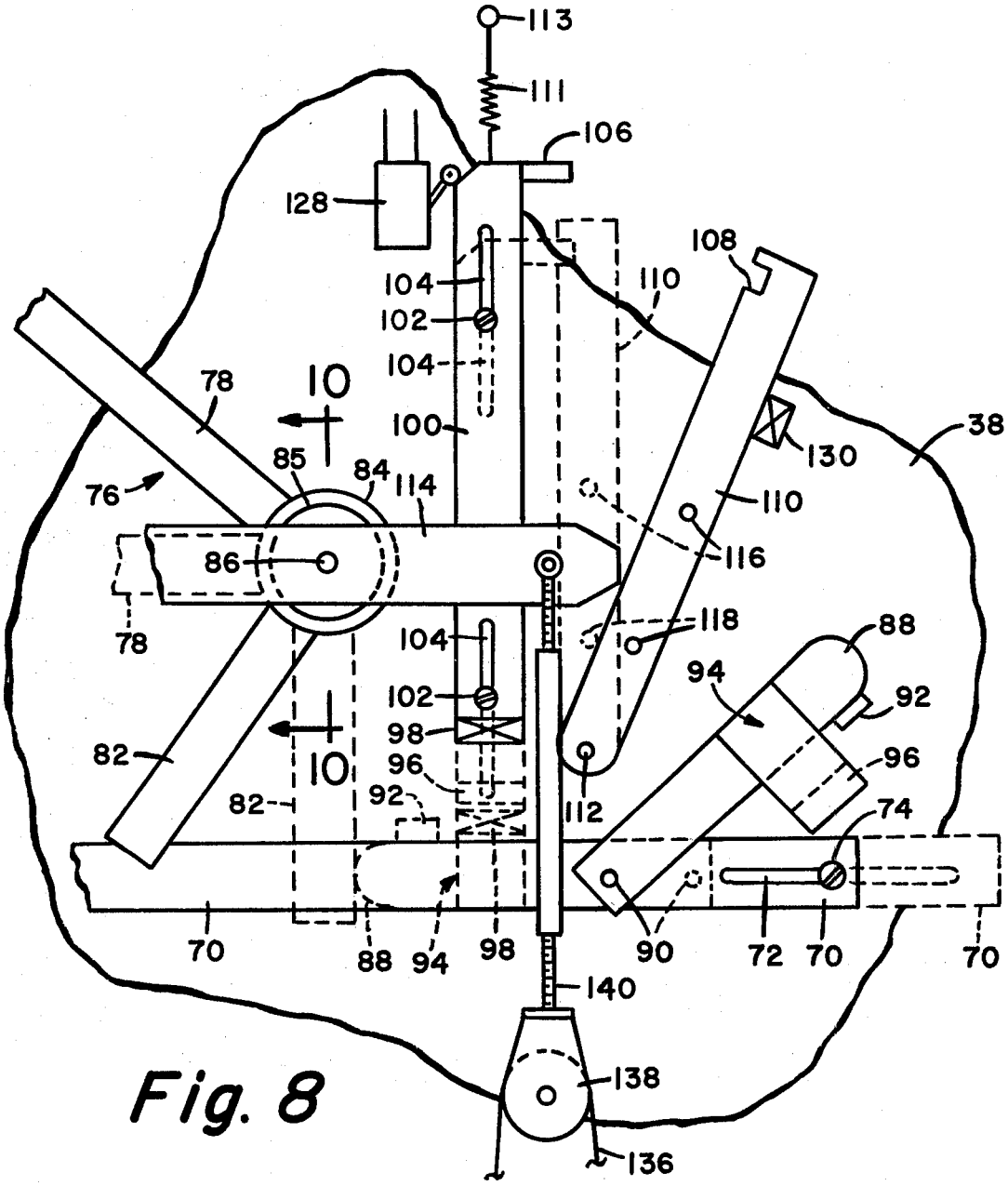
FIGS. 8–9 show, respectively, a side elevation view and a top plan view of a portion of the control panel of FIGS. 4–5 illustrating the safety latch engagement condition thereof.
Figure 9:
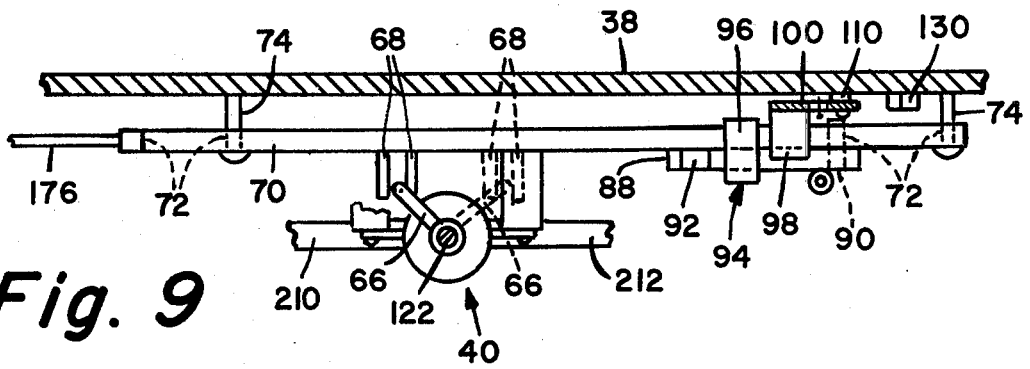
Figure 10:
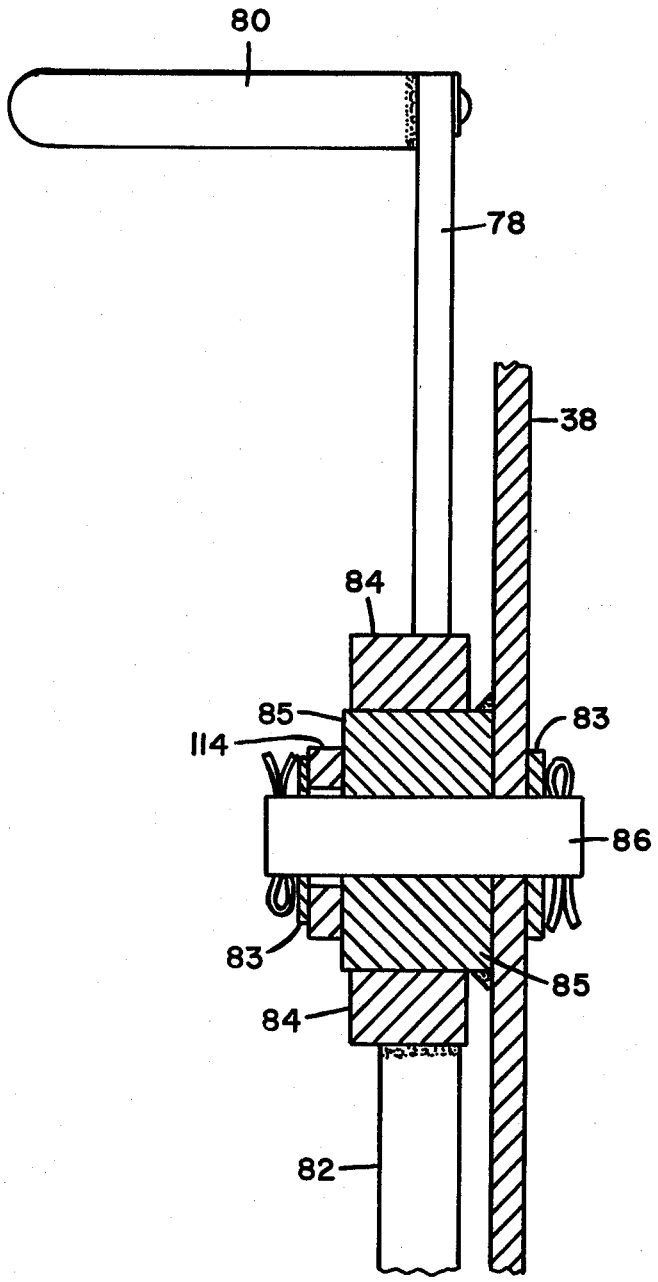
FIG. 10 shows an end elevation view of a double pivot mechanism, being a cross-sectioned portion of the control panel of FIG. 8 as viewed along lines 10—10 thereof.

An elongated lever bar 114 is pivotally attached to the plate 38 by means of a pin 86 projecting through the disc 85 so that the pivotal movement of the bar 114 is independent of the pivotal movement of the lever 76 (See particularly FIG. 10). A free end of the lever 114 extends across the broad surfaces of the vertical slide bar 100 and latch 110 between a pair of pins 116 and 118 which project outward toward the viewer from the latch 110. The other end of the lever 114 is pivotally connected by means of a pivot pin 120 to an adjustable threaded member 122 connected to a plug or seal which encloses the upper end of the valve cylinder 42. A pair of rectangular plates 124 form a joint in which both the relatively thin lever bar 114 and the cylindrically shaped member 122 may be interconnected. It may be found necessary to form elongated slots 126 through the plates 124 to provide a sufficient degree of freedom of movement of the bar 114 and member 122 about the pin 120. A normally closed electrical microswitch 128 of any suitable well known type is fixedly attached to the plate 38 above the upper end of the vertical slide bar 100 and is disposed so as to be tripped to an open position as the bar 100 rises vertically as shown in FIG. 8. A block 130 is attached to the plate 38 and disposed so as to interfere with and stop the clockwise rotation of the latch 110 as the same becomes disengaged from the bar 100, also as shown in FIG. 8.

In its normal operating position, the lever bar 114 extends preferably horizontally with its free end disposed equidistant between and spaced from the pins 116 and 118, and with its pivotal end adjoining the pin 120 at a right angle to the longitudinal dimension of the valve cylinder 42. A spring 132 is connected between the lower end of the cylinder 42 and a peg 134 fixedly attached to the plate 38 to rotationally bias the pivotal end of the bar 114 toward counterclockwise rotation. Such rotational bias is transferred through the length of the cylinder 42 to the pivot pin 120. The counterclockwise bias is normally exactly counteracted by a clockwise rotational bias applied to the other end of the bar 114 by a steel cable 136 strung under a predetermined tension through a pulley 138 suspended from a free end portion of the bar 114 by an adjustable threaded member 140.

The cable 136 extends through a series of pulleys 142, 144, 138, 146 and 148 between a pair of pins 150 and 152 fixedly attached to the carriages 18 and 20 for movement therewith. Once the proper tension is set on the cable 136 by adjustment of the threaded member 140 to neutralize the bias applied to the other end of the lever bar 114 by the spring 132, the cable tension will remain unchanged so long as the carriages 18 and 20 maintain the desired vertical alignment or displacement relative to one another during their movement up and down the frames 14 and 16. Ordinarily, it will be desired to maintain the carriages 18 and 20 at the same vertical height above the supporting surface of the assemblies 10 and 12 at all times during vertical movement, but different levels of relative carriage alignment could be selected if desired to accomplish some special purpose. The pulley 142 should be suspended from the frame 14 at such a height as to insure that it will always be above the highest position of the pin 150. The pulleys 146 and 148 are mounted on the supporting base plates 32 of the assemblies 10 and 12 so that the portion of the cable 136 extending across the space between the assemblies 10 and 12 will be at ground level. In this manner, an elongated shield or cover housing, not shown, of any suitable type can be applied over this portion of the cable 136 to protect it from vehicles driven thereover when being mounted on or removed from the support arms 22 and 24. The pulley 144 is mounted on a pivot pin which is fixedly attached to the plate 38 at a level which insures downward pressure of the cable 136 on the suspended pulley 138 regardless of the adjustment made in the length of the member 140. Accordingly, such disposition of the pulley 144 also insures the application of a proper clockwise rotational bias to the free end of the bar 114 at all times. Now, so long as the arms 22 and 24 maintain their proper relative vertical displacement during translation of the carriages 18 and 20, the tension in the cable 136 will remain constant at its preselected value to maintain the bar 114 in its preferred position of horizontal alignment. As a result and with proper calibration of the valve 40, fluid flow to and from each of the lifting cylinders 26 and 28 will remain equal. However, should the arms 22 and 24 move out of their preferred vertical alignment with respect to each other, the tension in cable 136 will change so as to cause the bar 114 to rotate about pin 86 in such a direction as to cause the valve 40 to adjust the relative rate of flow of hydraulic fluid to and from the lifting cylinders 26 and 28 to bring the arms 22 and 24 back into proper alignment.

Now in the event of a control system failure, the assemblies 10 and 12 are also provided with a pair of trapezoidal shaped carriage safety latches or dogs 154 and 156 which are pivotally connected to the double arms of a pair of carriage support braces 158 and 160 by means of pivot pins 162 and 164, respectively. When the assemblies 10 and 12 are operated in the up condition as illustrated in FIG. 4, the dogs 154 and 156 are urged to an extended position to engage a series of spaced blocks 166 and 168, respectively, attached in vertical alignment on a rear wall 169 of each of the assemblies 10 and 12 like rungs on a ladder. Accordingly, the blocks 166 and 168 act as ratchet-like latches while the dogs 154 and 156 function in a pawl-like manner. Since the operation and structure of the dogs 154 and 156 and their associated components is similar, only the safety latch assembly associated with the assembly 10 need be explained in detail.

In effect the dog 154 is biased toward its extended position of engagement with the blocks 166 at all times by means of a flat steel strap 170 connected at one end to the top of the cylinder 26. Now as the cylinder 26 rises during normal operation of the assembly 10 in the up condition (See FIG. 4), the dog 154 simply slides across the blocks 166 due to the resilience of the strap 170. A rectangular bar 172 welded across the upper edges of the arms of the carriage braces 158 restrains the dog 154 from deflecting upward off of any one of the blocks 166 so as to rotate above its extended block engaging position in line with the horizontal end portion of the braces 158. Thus, the dog 154 is always in a position to lock the carriage 18 in place should an emergency occur at any time during the upward operation or condition of the assembly 10. Similarly, the dog 156 is always extended for locking the carriage 20 in place should an emergency occur at any time during the upward operating condition of the assembly 12.

Figure 2:
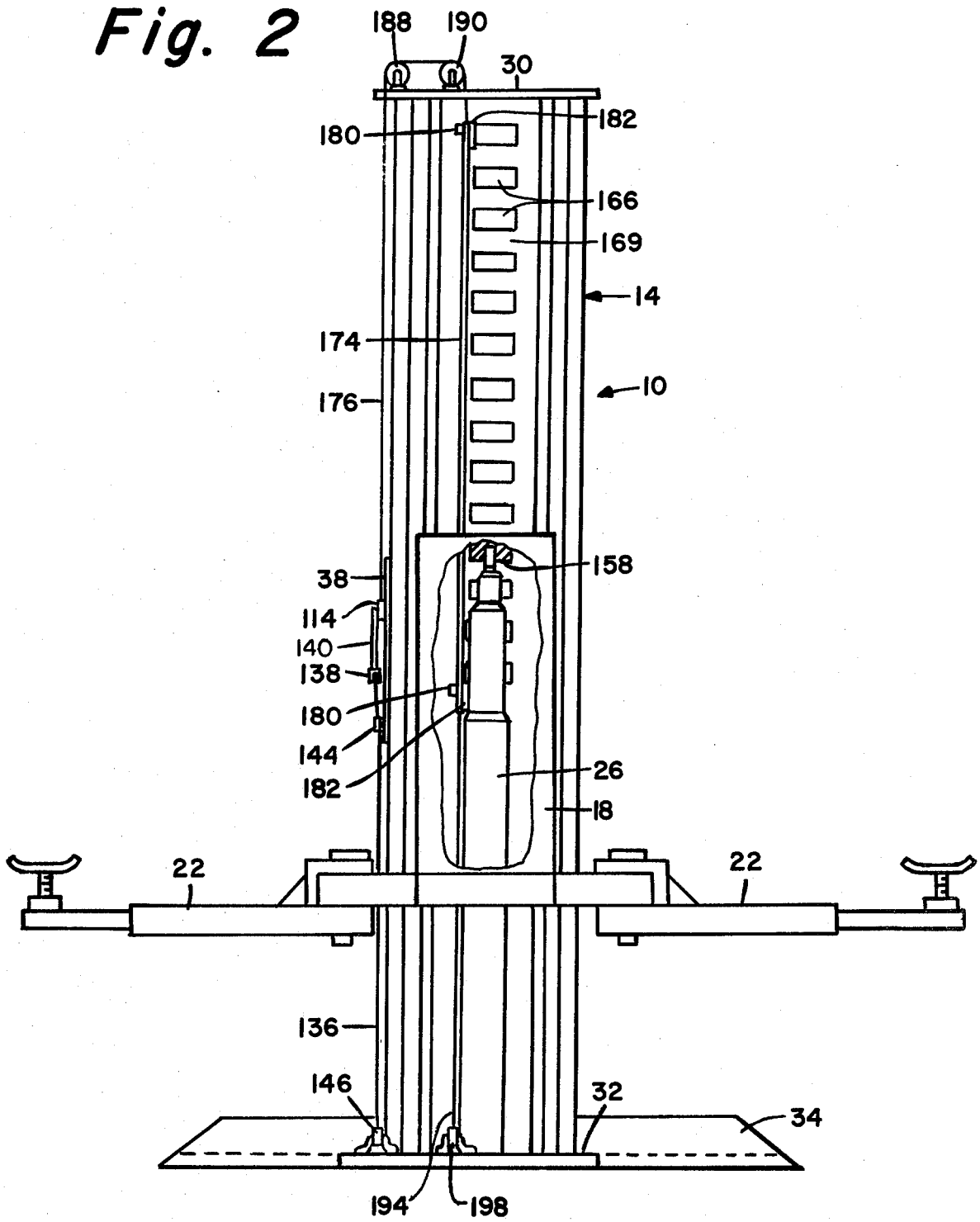
Figure 3:
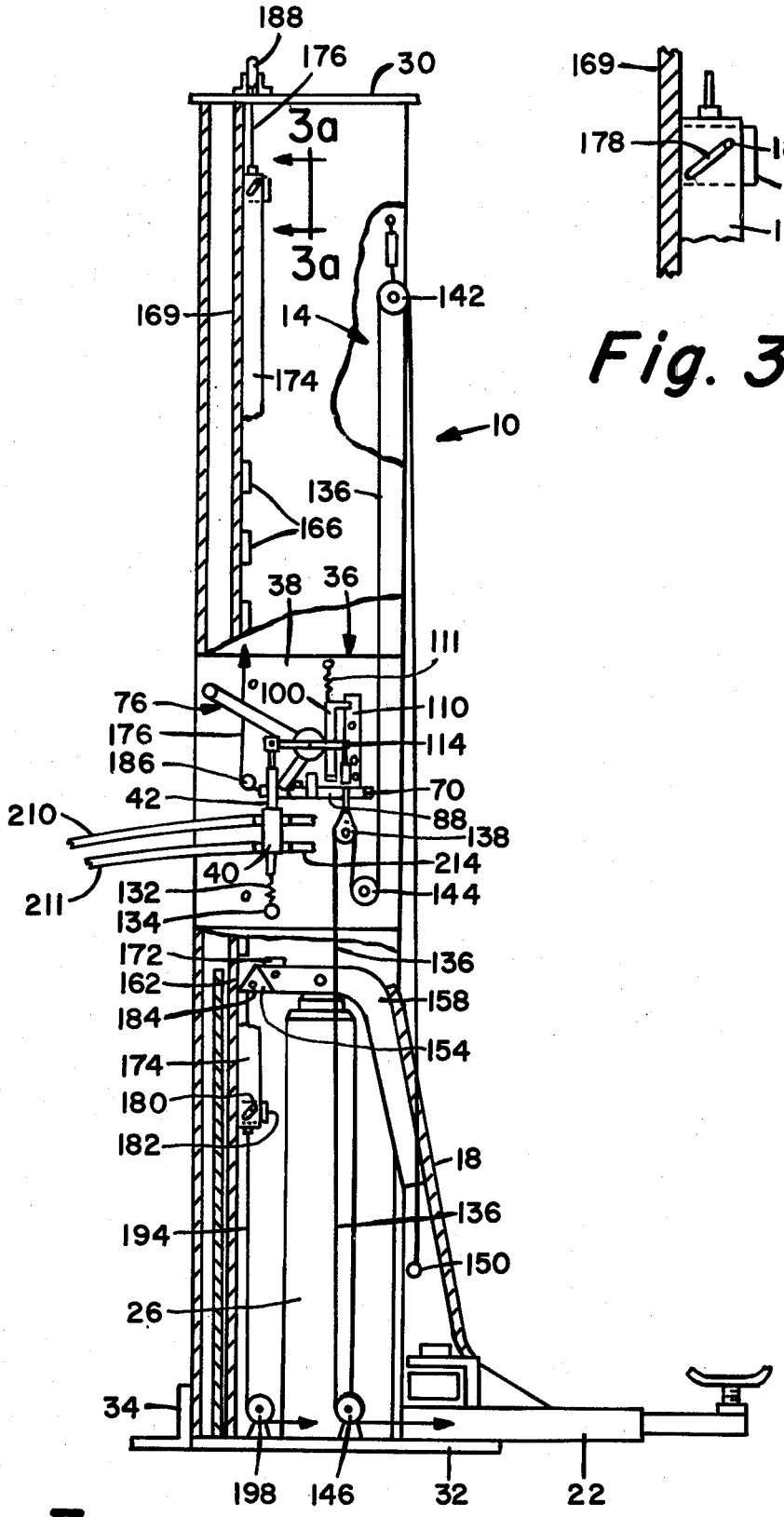
Figure 3A:
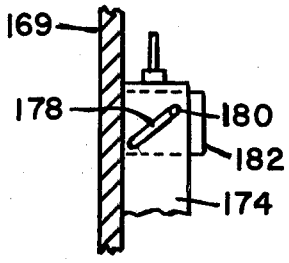
FIG. 3*a* shows an enlarged fragmented elevation view of a portion of the structure of FIGS. 1–3 illustrating the up condition of operation of the safety latch release bar.

When the assembly 10 is shifted to the downward mode of operation as shown in FIG. 5, an elongated rectangular latch release bar 174 is lifted both upwardly and outwardly away from the wall 169 by a steel cable 176 connected through a series of pulleys to one end of the slide bar 70. Such diagonal lifting movement is obtained by means of elongated slots 178 diagonally disposed on upper and lower end portions of the release bar 174 into each of which a guide pin 180 projects. The pins 180 are fixedly attached to a pair of plates 182 secured to the wall 169 adjacent to the top and bottom blocks 166 on the opposite side of the release bar 174 from the viewer. The outward edge of the release bar 174 presses against a pin 184 extending outwardly from a lower portion of the side of the dog 154 to overcome the bias of the strap 170 and deflect the dog 154 during the downward condition or movement of the assembly 10 as shown in FIG. 5. In actual practice, the cable 176 is strung through a series of pulleys 186, 188 and 190 in the manner as shown in FIGS. 1–3. However, for purposes of clarity in the side views of FIGS. 4 and 5, the two pulleys 188 and 190 or the top plate 30 are represented schematically by a single pulley 192.

To complete the safety latch assembly and associated components, a steel cable 194 is strung between the bottom ends of the latch release bar 174 and its companion release bar 196 through pulleys 198 and 200 mounted on the base plates 32. The portion of the cable 194 extending horizontally across the space between the assemblies 10 and 12 at nearly ground level can also be housed in a suitable cover housing, not shown, to protect it from a vehicle being driven thereover in the same manner as previously explained for the protection of the cable 136. A conventional turnbuckle 202 may be provided as shown in FIGS. 4–5 to permit adjustment of the tension in the cable 194. The operation of the release bar 196 in the assembly 12 is similar to that of the release bar 174. Accordingly, elongated diagonally disposed slots 178 are formed in top and bottom end portions thereof through which pins 180 are slidably inserted, the latter being fixed to a pair of plates 182.

Figure 11:
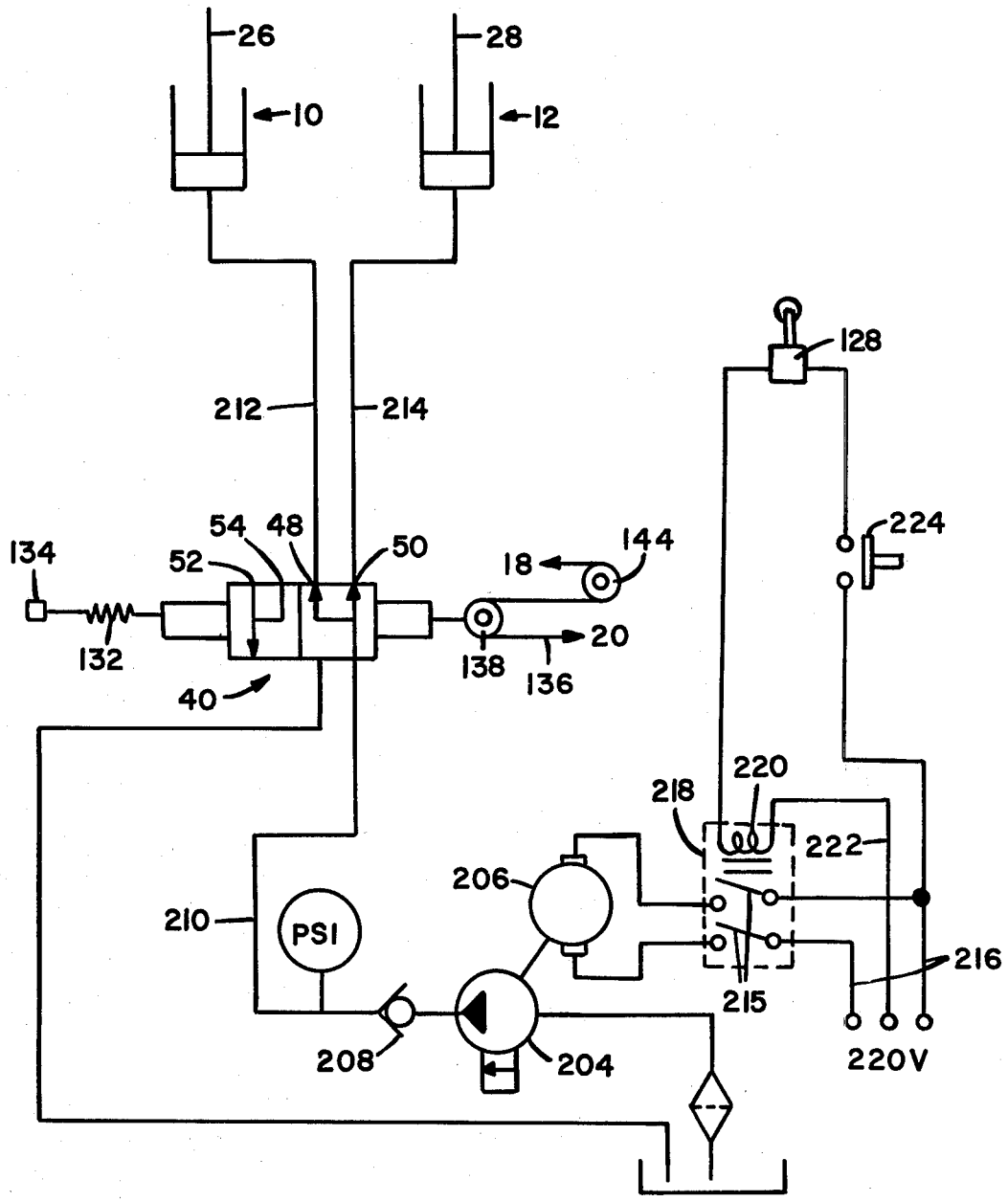
FIG. 11 shows a schematic diagram of the electrical and hydraulic circuitry of the assemblies of FIGS. 1–3.

Referring now particularly to FIG. 11, the hydraulic and electrical systems for operation of the assemblies 10 and 12 in conjunction with the control system of the instant invention is shown including a suitable hydraulic pump 204 and pump drive motor 206 of any well known type. During upward operation of the assemblies 10 and 12, operating fluid is pumped through a check valve 208 and a line 210 to the shuttle valve 40, thence through the lifting cylinder access ports 60 and 62 and lines 212 and 214 to the lifting cylinders 26 and 28. During upward operation, should the carriage 18 rise faster than the carriage 20, the tension in the cable 136 will relax causing the bias of the spring 132 to rotate the lever bar 114 counterclockwise and force the cylinder 42 downward through the valve body 44. Such action of the cylinder 44 will decrease the area of registry of the hole 48 with the access port 60 to reduce the rate of flow of hydraulic fluid to the cylinder 26. Simultaneously, the downward movement of the cylinder 42 will increase the area of registry of the hole 50 with the access port 62 to increase the hydraulic fluid flow rate to the cylinder 28. As a result, the speed of extension of the cylinder 26 will decline while the speed of extension of the cylinder 28 will increase until the two cylinders are properly aligned horizontally with one another thus simultaneously increasing the tension in the cable 136 back to its normal operating value. The lever bar 114, which will have rotated counterclockwise as the cylinder 42 moved downward from its normal operating position, will now return to its normal horizontal position as the tension in the cable 136 increases back to its normal operating value. FIG. 11 shows, in a simplified schematic manner, the counteracting forces exerted on the shuttle valve 40 by the spring 132 as opposed to the cable 136.

The electrical system of the subject example consists of a 220 volt circuit 216 for supplying power to the pump motor 206 through the contacts 215 of a normally open single pole-double throw 110 volt relay 218 of any suitable and conventional type. The 110 volt relay coil 220 which effects closure of the contacts 215 is connected between ground 222 and one side of the 220 volt circuit 216 through the series combination of a normally open 110 volt on/off switch 224, which may be of the common push button type, and the microswitch 128.

Now should the control system operating the shuttle valve 40 fail, such that the carriages 18 and 20 become vertically misaligned up to the limits of safety, the free end of the bar 114 will rotate clockwise upward to engage the pin 116 and trip the latch 110 free of the slide bar 100 as the carriage 18 moves upwardly beyond the carriage 20. On the other hand, should the carriage 18 lag too far beneath the level of the carriage 20 during their upward movement, tension in the cable 136 will increase beyond its normal value to rotate the free end of the bar 114 clockwise downward into engagement with the pin 118 to trip the latch 110 free of the slide bar 100. In either case of carriage misalignment, the freed slide bar 100 will be drawn upward by the spring 111 to open the microswitch 128 and deenergize the relay coil 220, thus opening the contacts 215 to shut down the motor 206 and pump 204. Should this action occur while the carriages are operating in the upward mode, the dogs 154 and 156, which are already in an extended position, will simply come to rest upon the upper edge of the nearest blocks 166 and 168, respectively, that are immediately below the bottom edge of the dogs at that time. Simultaneously, the motor 206 is shut down by movement of the slide bar 100 against the microswitch 128 and the dogs 154 and 156 lock the carriages 18 and 20 against the frames 14 and 16.

Now should the shuttle valve 40 fail to correct a vertical misalignment of the carriages 18 and 20 while they are in the downward operating mode (Refer to FIG. 5 and FIG. 8), the latch 110 will trip free of the slide bar 100 causing the block 98 on the lower end of the bar 100 to rise into engagement with the overlying block 96 attached to the member 88. As a result, the latter will rapidly trip and rotate clockwise about the pin 90, thus freeing the horizontal slide bar 70 to slide behind the leg 82 from a retracted position as shown in FIG. 5 to an extended position as shown in FIG. 4. Movement of the slide bar 70 from the right to the left is produced by the tension in the cable 176 caused by the weight of the release bar 174 suspended therefrom. The movement of the now freed slide bar 70 from its normally retracted position in the downward mode of operation, to an extended position, allows the release bar 174 to fall diagonally downwardly into the wall 169 along the pins 180, whereby the dogs 154 and 156 are urged by the straps 170 into their extended position of engagement with the blocks 166. The rotation of the member 88 out of engagement with the leg 82 by action of the vertical slide bar 100 permits relaxation of the release bar 174 back against the wall 169 to engage the dog 154. As the release bar 174 relaxes downward and rearward against the wall 169, the cable 194 is loosened to allow the companion release bar 196 to be drawn diagonally upward and rearward against the wall 169 of the assembly 12 by action of a spring 226 from which it is suspended. Notice that when the bar 174 is drawn upward and outward away from the wall 169 of assembly 10 by the slide bar 70, the tension in the cable 194 is increased so as to pull the companion slide bar 196 downward and outward away from the wall 169 to stretch the spring 226.

With regard to the sensitivity of the control system of the subject invention, the distance between the pivot pin 86 on which the bar 114 rotates and the pivot pin 120 as compared with the distance between the pivot pin 86 and the member 140 from which the cable 136 is suspended is critical. While these two distances may be of equal value, amplification of an error in the vertical displacement of the carriages 18 and 20 can be obtained in order to provide increased sensitivity in the valve 40 by making the former distance greater than the latter distance. For example, it has been found that where the distance between pins 86 and 120 is twice the distance between the pin 86 and the member 140, then the sensitivity of the valve 40 to changes in tension in the cable 136 is markedly increased over what it ordinarily is when both distances are equal. While the ratio of these distances to effect a desired sensitivity to changes in tension in the cable 136 is a matter of design choice, it is worthwhile to mention that such a choice exists.

Although the subject invention has been described with respect to specific details of certain preferred embodiments thereof, it is not intended that such details limit the scope of the subject invention except insofar as is set forth in the following claims.

I claim:

1. A control system for a pair of independently movable translating means comprising means for sensing a change in the relative displacement of said pair away from a preferred relative displacement of said pair, said sensing means including a length of cable strung between and connected at its ends to said pair under a predetermined value of tension when said pair is disposed in said predetermined relative displacement, the tension in said cable being variable as a function of said change, and means connected to said cable and responsive to a variation in said tension away from said preselected value, for operating said translating means in such a manner as to limit said change.

2. A method for controlling the movement of a pair of independently movable translating means, the steps of which comprise sensing a change in tension in a cable strung between and connected at its ends to said pair away from a predetermined value of said tension, and operating said translating means in such a manner as to limit said tension change.

3. A control system for a pair of independently movable translating means comprising means for sensing a change in the relative displacement of said pair away from a preferred relative displacement of said pair, means operatively connected to said pair and responsive to said change, for automatically restoring said pair to said preferred relative displacement, and means for locking said pair in place to render said pair immovable to limit said change to a maximum value.

4. The system of claim 3 wherein said locking means comprises ratchet means linearly disposed alongside the line of travel of each of said pair of translating means, pawl means attached to each of said translating means for movement therewith for sliding across said ratchet means during movement of said translating means in one direction and for engaging said ratchet means to lock said translating means in a stationary position when said translating means move in the other direction when said change reaches said maximum value, and means for maintaining disengagement between said ratchet and pawl means when said translating means move in said other direction only so long as said change is less than said maximum value.

5. The system of claim 3 wherein said locking means comprises a series of spaced latches fixedly disposed alongside the line of travel of said translating means, a pair of latch engagable dogs movably attached to said translating means, biasing means connected to each of said translating means tending to move each of said dogs toward locking engagement with said latches, and means opposing said biasing means for restraining the engagement of said dogs with said latches when said translating means are moving in one direction but only so long as said change is less than said maximum value.

6. A control system for a pair of independently movable translating means comprising means for sensing a change in the relative displacement of said pair away from a preferred relative displacement of said pair, and a fluid shuttle valve operatively connected to said pair and responsive to said change for automatically restoring said pair to said preferred relative displacement.

7. The system of claim 6 wherein said fluid shuttle valve comprises a housing defining a cylindrically shaped hollow shaft and an externally accessible fluid inlet, outlet, first access and second access port communicating with said shaft, a cylinder having closed ends and defining a hollow cavity therein, said cylinder being slidably disposed in said shaft both rotationally and longitudinally, first means for effecting communication between said first and second access ports, said cavity and said inlet port when said cylinder is disposed in a first position of rotational displacement relative to said housing, said first means being adapted to reduce the rate of flow of a fluid between one of said access ports and said cavity and simultaneously increase the rate of flow of said fluid between the other of said access ports and said cavity when said cylinder is moved longitudinally in one direction through said shaft past a preselected position, and to increase the rate of flow of said fluid between said one access port and cavity and simultaneously reduce said rate of flow between the other of said access ports and cavity when said cylinder is moved longitudinally in the opposite direction through said shaft past said preselected position, and second means for effecting communication between said first and second access ports, said cavity and said outlet port when said cylinder is disposed in a second position of rotational displacement relative to said housing, said second means being adapted to increase said rate of flow between one of said access ports and said cavity and simultaneously decrease said rate of flow between the other of said access ports and said cavity when said cylinder is moved longitudinally through said shaft in one direction past said preselected position, and to decrease said rate of flow between said one of said access ports and said cavity and simultaneously increase said rate of flow between the other of said access ports and cavity as said cylinder is moved longitudinally in said other direction past said preselected position.

8. In an improved pair of lifting assemblies of the type comprising first and second frames, first and second vertically movable carriages movably mounted on said first and second frames, respectively, and first and second fluid operated lifting cylinders disposed in said first and second frames, respectively, and operatively connected to said first and second carriages, respectively, the improvement of which comprises a first cable strung between said first and second carriages under a predetermined amount of tension when said carriages are disposed in a preselected position of vertical displacement relative to one another such that the tension in said cable decreases below said preselected amount when said first carriage is higher than said second carriage and when said carriages move beyond said preselected position relative to one another, and such that said tension increases above said preselected amount when said first carriage is lower than said second carriage and when said carriages move beyond said preselected position relative to one another, a lever being pivotally disposed relative to one of said frames, said first cable being operatively associated with one end of said lever for rotationally biasing said lever in one direction of rotation with a torque dependent upon the tension in said first cable, fluid valve means operatively associated with said cylinders for raising and lowering said carriages, and connected to the other end of said lever, means for biasing said valve means to a preselected operating position and for rotationally biasing said lever in the other direction of rotation sufficient to counteract the rotational bias applied to said lever in said one direction by said first cable, and for maintaining preselected rates of fluid flow to and from each of said cylinders when the tension in said cable is equal to said preselected amount, and means associated with said valve means for increasing the flow rate of a fluid to and from one of said cylinders while simultaneously decreasing the flow rate of said fluid to and from the other of said cylinders in response to a change in the tension in said first cable from said preselected amount, to eliminate said change in tension and restore said carriages to said preselected position relative to one another, said associated means being responsively connected to said other end of said lever and to said valve biasing means.

9. A safety latch system for a pair of powered lifting means comprising first and second frames for said lifting means, a first series of spaced latches affixed to said first frame along a line parallel to the path of movement of one of said lifting means, a second series of spaced latches affixed to said second frame along a line parallel to the path of movement of the other of said lifting means, a pair of latch engagable dogs, each of said dogs being movably attached to a different one of said lifting means for movement therewith in line with said latches, means attached to each of said lifting means for biasing each of said dogs toward locking engagement with said latches, means for sensing a preselected maximum change in a preferred position of displacement of one of said lifting means relative to the other of said lifting means, latch releasing means disposed adjacent said first and second frames alongside said first and second series of latches, for resisting said biasing means when both of said lifting means are in a downward operating condition to thereby restrain said dogs from engaging said first and second series of latches so long as the relative vertical displacement between said pair of lifting means is less than said preselected maximum value, said latch releasing means being responsively connected to said sensing means to cease resisting said biasing means when said change equals said preselected maximum value, and disabling means responsively connected to said sensing means and operatively connected to said lifting means for rendering said lifting means powerless when said change is equal to said preselected maximum value.

10. The system of claim 9 wherein said latch releasing means comprises a pair of elongated rectangular bars movably suspended adjacent to said first and second frames for movement diagonally away from said wall to resist said biasing means when said lifting means are placed in a downwardly operating condition, provided said change is less than said preselected maximum value, and for movement diagonally toward said wall to allow said biasing means to effect engagement of said dogs with said latches when said change becomes equal to said maximum preselected value.

11. The system of claim 9 wherein said dogs comprise a pair of trapezoidally shaped pawl-like members pivotally attached to said lifting means, said series of latches forming ratchet-like members for permitting said dogs to slide across said latches while in an extended latch engagable position as said lifting means move in an upward direction, and for permitting said dogs to catch against said latches to lock said lifting means against said frames when said lifting means are in a downward operating condition and only when said change becomes equal to said preselected maximum value.

12. A safety latch system for a pair of powered lifting means comprising first and second frames for said lifting means, ratchet means formed on said frames disposed alongside the line of travel of said lifting means, pawl means attached to said lifting means for sliding across said ratchet means when said lifting means move in one direction, and for engaging said ratchet means to lock said lifting means against said frames when said lifting means move in the other direction and when the relative displacement between said lifting means is equal to a preselected maximum value, means for maintaining disengagement between said ratchet and pawl means when said lifting means move in said other direction only so long as the relative displacement between said lifting means is less than said preselected maximum value, means for automatically changing said lifting means from operation in said one direction to operation in said other direction when said relative displacement reaches said preselected maximum value as said lifting means are moving in said one direction, and means for disabling said lifting means to render the same immovable when said relative displacement reaches said maximum preselected value.

13. A method for controlling the movement of a pair of independently movable translating means, the steps of which comprise sensing a change in the relative displacement of said pair from a preferred relative displacement, restoring said pair of said preferred relative displacement to automatically eliminate said change, and locking said pair in place to render said pair immovable when said change reaches a preselected maximum amount.

14. The method of claim 13, the steps of which further comprise deactivating said pair to render said pair powerless when said change reaches said preselected maximum amount.

15. A control system for a pair of independently movable translating means comprising means for sensing a change in the relative displacement of said pair away from a preferred relative displacement of said pair, and means operatively connected to said pair and responsive to said change, for automatically restoring said pair to said preferred relative displacement, said sensing means further comprising a cable strung between said pair under a preselected amount of tension when said pair is disposed in said preferred relative displacement, said cable tension being variable as a function of said change, said restoring means being responsively connected to said cable and responsive to a variation in said tension from said preselected amount.

16. The system of claim 15 wherein said sensing means further comprises a lever pivotally disposed relative to one of said pair, said cable being operatively connected to one end portion of said lever for biasing said lever in one direction of rotation with a torque dependent upon said cable tension, and means connected to the other end portion of said lever for biasing said lever in the other direction or rotation sufficient to counteract the rotational bias applied to said one end of said lever by said cable when said cable tension is equal to said preselected amount, whereby a rotation of said lever away from its normal position, when said tension is equal to said preselected amount, is indicative of said change.

17. The system of claim 15 further comprising a pair of stationary frames attached to said translating means, a lever bar pivotally mounted relative to one of said frames, means connecting said cable to one end portion of said lever bar for biasing said lever bar toward one direction of rotation with a torque dependent upon the magnitude of said cable tension, means for biasing the other end of said lever bar toward the other direction of rotation to stabilize said lever bar in a preferred position of alignment when said cable tension is equal to said preselected value, and means responsively connected to said other end of said lever bar for controlling the relative movement of said translating means to minimize said change.

18. The system of claim 17 further comprising latch means pivotally connected to said one frame and responsive to a preselected maximum rotational displacement of said lever bar from said preferred position of alignment, a slide bar slidably mounted on said one frame and confinable in a retracted position by said latch means when the rotational displacement of said lever bar is less than said preselected maximum rotational displacement, means for biasing said slide bar toward an extended position, limiting means for disengaging said latch means and slide bar when the rotational displacement of said lever bar equals said preselected maximum rotational displacement, means for deactivating said translating means in response to a movement of said slide bar from said retracted position to said extended position, and means for locking said translating means to said frames to render said translating means immovable in response to said slide bar movement.

* * * * *